US006464811B1

(12) United States Patent
Meier et al.

(10) Patent No.: US 6,464,811 B1
(45) Date of Patent: Oct. 15, 2002

(54) METHOD AND DEVICE FOR APPLYING PRETENSED TENSION-PROOF REINFORCING STRIPS TO A CONSTRUCTION

(75) Inventors: Urs Meier, Schwerzenbach; Iwan Stöcklin, Ettingen; Andreas Winistörfer, Pfäffikon, all of (CH)

(73) Assignee: Eidgenössiche Materialprüfungs-und Forschungsanstalt EMPA, Dübendorf (CH)

( * ) Notice: Subject to any disclaimer, the term of this patent is extended or adjusted under 35 U.S.C. 154(b) by 0 days.

(21) Appl. No.: 09/622,111

(22) PCT Filed: Feb. 16, 1999

(86) PCT No.: PCT/CH99/00076

§ 371 (c)(1),
(2), (4) Date: Oct. 5, 2000

(87) PCT Pub. No.: WO99/43909

PCT Pub. Date: Sep. 2, 1999

(30) Foreign Application Priority Data

Feb. 26, 1998 (CH) ..... 454/98

(51) Int. Cl.[7] ..... E04C 5/07; E04G 21/12; B32B 31/12

(52) U.S. Cl. ..... 156/71; 156/160; 156/229; 156/391; 156/494; 156/583.1

(58) Field of Search ..... 52/108, 127.5, 52/147–152, 649.1, 650.1, 655.1, 703, 712, 745.21; 156/71, 157, 156, 160–164, 166, 171, 175, 272.2, 275.5, 380.6, 391, 449, 494, 496, 499, 583.1, 359, 581, 228, 229, 295

(56) References Cited

U.S. PATENT DOCUMENTS 5,617,685 A * 4/1997 Meier et al. ..... 52/223.13
5,683,530 A * 11/1997 Fawley et al. ..... 156/71
5,799,451 A * 9/1998 Pilakoutas ..... 52/223.4

FOREIGN PATENT DOCUMENTS

FR 2594871 A1 * 8/1987 ..... E04C/3/26

OTHER PUBLICATIONS

J. Bresson: "Nouvelles recherches et applications concernant l'utilisation des collages dans les structures Beton plaqué," Annales ITBTP No. 278 (1971), Série beton, Beton armé No. 116.

Ladner, M., Ch.: "Geklebte Bewehrung im Stahlbetonbau (Concrete Structures with Bonded External Reinforcement)," Swiss Federal Laboratories for Materials Testing and Research (EMPA) Dübendorf, Report No. 206 (1981).

(List continued on next page.)

*Primary Examiner*—Curtis Mayes
*Assistant Examiner*—Sing P. Chan
(74) *Attorney, Agent, or Firm*—Pauley Petersen Kinne & Erickson

(57) ABSTRACT

Lamellar, fibre-reinforced plastic strips can be used to reinforce a linearly expanded or flat construction part having a support function against any bending stress to which it is exposed. The strips are usually applied to the construction from the outside, or from the inside in the case of hollow structures, and fixed by an adhesive. The lamellar strips are pretensed with a tensioning device, treated with adhesive in a pretensed state, and then moved to the area to be treated together with the tension device. The tension device is provisionally fixed to the construction with displaceable fixing devices and pressed against said construction. Thereafter the lamellar strips are pressed against the construction by means of an air bag or air hose until the adhesive has hardened.

11 Claims, 4 Drawing Sheets

OTHER PUBLICATIONS

Ladner, M. and Flüeler, P.: "Versuche an Stahlbetonbauteilen mit geklebter Armierung," ("Verstärkung von Tragkonstruktionen mit geklebter Armierung,") Schweizer Bauzeitung, special article in the 92nd year, vol. 19 (1974).

"Die Sanierung der Gizenenbrücke über Muota," Schweiz. Ingenieur & Architekt, special article in vol. 41 (1980).

U. Meier, "Brückensanierung mit Hochleistungs–Faserverbundwerkstoffen," published in Material + Technik, 15th year, vol. 4 (1987).

Dissertation by H. P. Kaiser, Dissertation ETH Zürich (1989), ETH Dissertation No. 8918.

* cited by examiner

METHOD AND DEVICE FOR APPLYING PRETENSED TENSION-PROOF REINFORCING STRIPS TO A CONSTRUCTION

BACKGROUND OF THE INVENTION

1. Field of the Invention

This invention relates to a method and a device for applying prestressed, tension-proof reinforcing strips to constructions, the strips being fixed to the construction with an adhesive.

2. Description of Related Art

For many years, both research and practical work have been done to find a way of strengthening steel concrete constructions after completion by applying an additional reinforcement. The beginnings of this technology are described in a report by J. Bresson entitled "Nouvelles recherches et applications conçemant l'utilisation des collages dans les structures Beton plaqué", Annales ITBTP No. 278 (1971), Série beton, Beton armé No. 116. The technique dates back to the 1960s. Bresson concentrated on research into the bonding stresses in the vicinity of the anchorages of lamellar steel strips bonded to constructions with adhesive. One advantage is that over the last 25 years, engineers have been able to reinforce existing steel constructions such as bridges, bed-plates, overhead plates, longitudinal supports and the like by subsequently applying lamellar steel strips with adhesive. The reinforcing of concrete constructions by applying lamellar steel strips using e.g. epoxy resin adhesives is now considered a standard technology. Depending on the particular case in hand, the purpose of such a reinforcement is to: increase the working load and alter the static system by removing supporting elements such as pillars, or by reducing the supporting function of such elements and strengthen elements at risk from fatigue stress, increase rigidity compensate damage to the support system or renovate existing constructions, and effect post-construction reinforcement in the event of faulty calculation or execution of a particular construction Post-construction reinforcement by means of applying lamellar steel strips with adhesive has been successfully used on numerous constructions, as described in, for example: Ladner, M., Ch.: "Geklebte Bewehrung im Stahlbetonbau", Swiss Federal Laboratories for Materials Testing and Research (EMPA) Dübendorf, Report No. 206 (1981); "Verstärkung von Tragkonstruktionen mit geklebter Armierung", Schweizer Bauzeitung, special article in the 92nd year, volume 19 (1974); "Die Sanierung der Gizenenbrücke über die Muota", Schweiz. Ingenieur & Architekt, special article in volume 41 (1980).

These conventional methods of reinforcement are, however, associated with certain disadvantages. Lamellar steel strips can only be supplied in short lengths, and hence only relatively short strips can be applied. This means that where there are lengthy spans, joints between the lamellae are unavoidable, thereby inevitably leading to potential weak spots. Furthermore, handling heavy lamellar steel strips on a building site is an awkward matter, and can cause considerable technical problems in the case of high-level constructions, or constructions which are otherwise difficult to access. In addition, there exists a risk of the steel rusting on the underside of the strips, even if corrosion protection treatment is carefully accomplished, i.e. of corrosion on the contact surface between the steel and the concrete, which can result in the strip becoming detached, and thus a loss of the reinforcement.

In the publication by U. Meier entitled "Brückensanierung mit Hochleistungs-Faserverbundwerkstoffen", published in Material+Technik, 15th year, volume 4 (1987), and in the dissertation by H. P. Kaiser, Dissertation ETH Zürich (1989), the proposed remedy is to place the lamellar steel strips with carbon fibre reinforced epoxy resin lamellae. Lamellar strips made from this material are characterized by a low bulk density, very high strength, excellent endurance properties and outstanding resistance to corrosion. Instead of heavy lamellar steel strips one can, therefore, also use light, thin, carbon fibre reinforced plastic strips which can be transported to the construction site on virtually endless reels. Practical tests have shown that carbon fibre lamellae of 0.5 mm thickness can absorb the same amount of tensile force as the yield strength of a 3 mm thick FE360 steel strip.

Hence post-construction reinforcement with carbon fibre lamellae fixed directly onto the construction by means of adhesive is already a state-of-the-art technology. The method involving reinforcement with steel lamellae has now largely been replaced by the method whereby the construction is reinforced with non-prestressed carbon fibre lamellae.

It has proved advantageous, particularly when using fibre composite lamellae of the type suggested in ETH Dissertation No. 8918, such as e.g. carbon fibre lamellae, to additionally prestress these lamellae disposed on the concrete construction part, thereby improving the utility of the part and preventing the lamella from shearing off as a result of shear fractures in the concrete in the tension zone. The enormous elastic extensibility of carbon fibre lamellae represents a big opportunity for the aforementioned prestressing operation. The large elastic extensibility and the modulus of elasticity, which is adjusted to the particular circumstances, have a positive impact on prestress losses due to shrinkage and creep.

French Patent Reference 2,594,871 disclosed a method whereby a prestressed strip is applied to the structure to be strengthened, namely to reinforced concrete, and bonded to this structure with adhesive. During the process the strip is prestressed until the adhesive hardens. The device shown in FIGS. 6 and 7 for executing this method is merely a strap held in place by a metal plate, which strap is used to hold the strip in place. This presupposes the availability of rigid anchorage points for attaching these straps, but these are not, however, always provided in practice, and are not disclosed in French Patent Reference 2,594,871. Furthermore, the method disclosed in that document does not allow for the strip to be pressed against the structure at the same time as the bonding process, as is required to achieve reliable bonding.

One remaining difficult point is therefore the problem of anchoring the carbon fibre lamellae during the prestressing process, given that prestressing forces are of several tens of thousands of N. These enormous forces have to maintain the lamella to be applied under tension against the construction itself, at least until the adhesive has hardened completely.

SUMMARY OF THE INVENTION

One object of this invention is to provide a method for applying tension-proof reinforcing strips to constructions which, irrespective of the availability of anchoring points on the construction for absorbing stressing forces, will allow the reinforcing strip to be prestressed and then applied, and which is reliable, simple and inexpensive to use. Another object of this invention is to provide a compact, simple, reliable device for executing this method, which is also inexpensive to manufacture.

This object is achieved with a method for applying prestressed, tension-proof reinforcing strips to constructions in which the strip to be applied is prestressed, pre-treated with adhesive and then positioned up to a construction and bonded to this structure. The method of this invention requires no anchorage points on the construction for absorbing stress forces because it is positioned up to the construction by a device on which the strip can be stretched under prestressing force, such as a device used to press the strip against the corresponding, pre-treated part of the construction until the adhesive hardens. The task is also solved with an apparatus for executing this method, as described in this specification and in the claims.

BRIEF DESCRIPTION OF THE DRAWINGS

The drawings show preferred embodiments of an apparatus which will be used to explain in detail the way the apparatus operates, and the nature of the method for applying the tension-proof reinforcing strips. The drawings show.

DESCRIPTION OF PREFERRED EMBODIMENTS

Figure 1A:
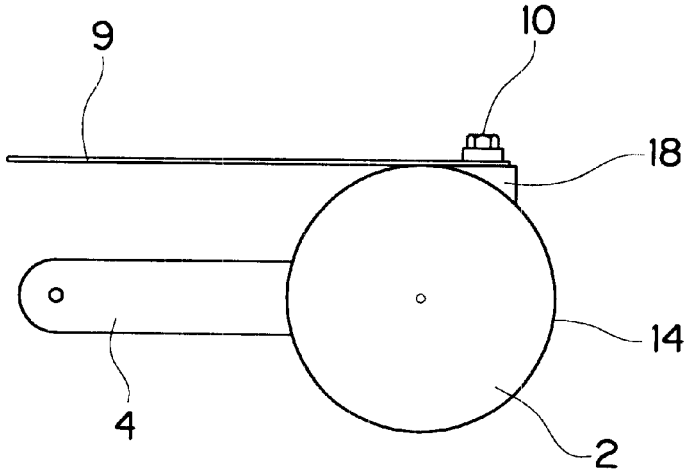
FIG. 1*a* is a schematic view of a stressing mechanism of a device prior to stressing a tension-proof strip.

FIG. 1*a* shows one basic principle of the device or apparatus of this invention. The device comprises a curved, rotatable surface 14, which is formed here by the outer surface of wheel 2. One end of the reinforcing strip to be prestressed, namely the fibre reinforced plastic lamella 9, is attached to the surface 14. The other end of plastic lamella 9 can be tension-proofly anchored by some other means, or in exactly the same way as shown. In the example shown, a holding device 18 is provided on the curved surface 14, i.e. in this case to the outside of the wheel, to which strip 9 can be fixed with clamps and at least one screw 10. The plastic lamella 9 is a strip which can be a few centimeters wide and about one millimeter thick. The curved rotatable surface 14, i.e. the wheel 2 in this example, is connected to a lever 4 which can be pivoted around the axis of the wheel, clockwise in this drawing, to rotate the wheel 2 and the curved surface 14 with it.

Figure 1B:
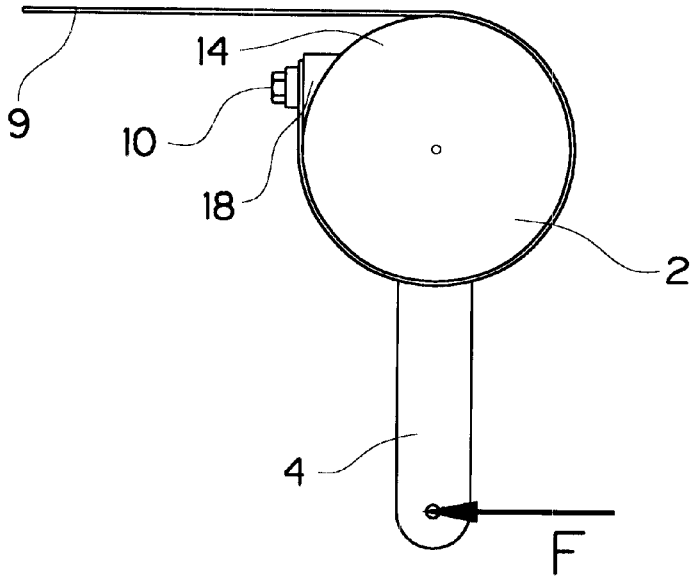
FIG. 1*b* is a schematic view of the stressing mechanism of the device during the process of stressing the tension-proof strip.

FIG. 1*b* shows this part of the device during the process of rotating wheel 2, whereby lever 4 is subjected to a force F that is as tangential as possible to wheel 2. This winds reinforcing strip 9 around wheel 2; in the embodiment shown, the reinforcing strip 9 is wound around curved surface 14 by 270°. The high tensile force also has an impact on the static friction of strip 9 against curved surface 14, because a very high normal force takes effect. Tests have shown that if the strip is only wound around half the circumference, i.e. 180°, the effective tensile force at the end of strip 9 is reduced by as much as a quarter in the direction of the strip 9. This knowledge forms one basic concept of the construction of the device and the method according to this invention.

Figure 2:
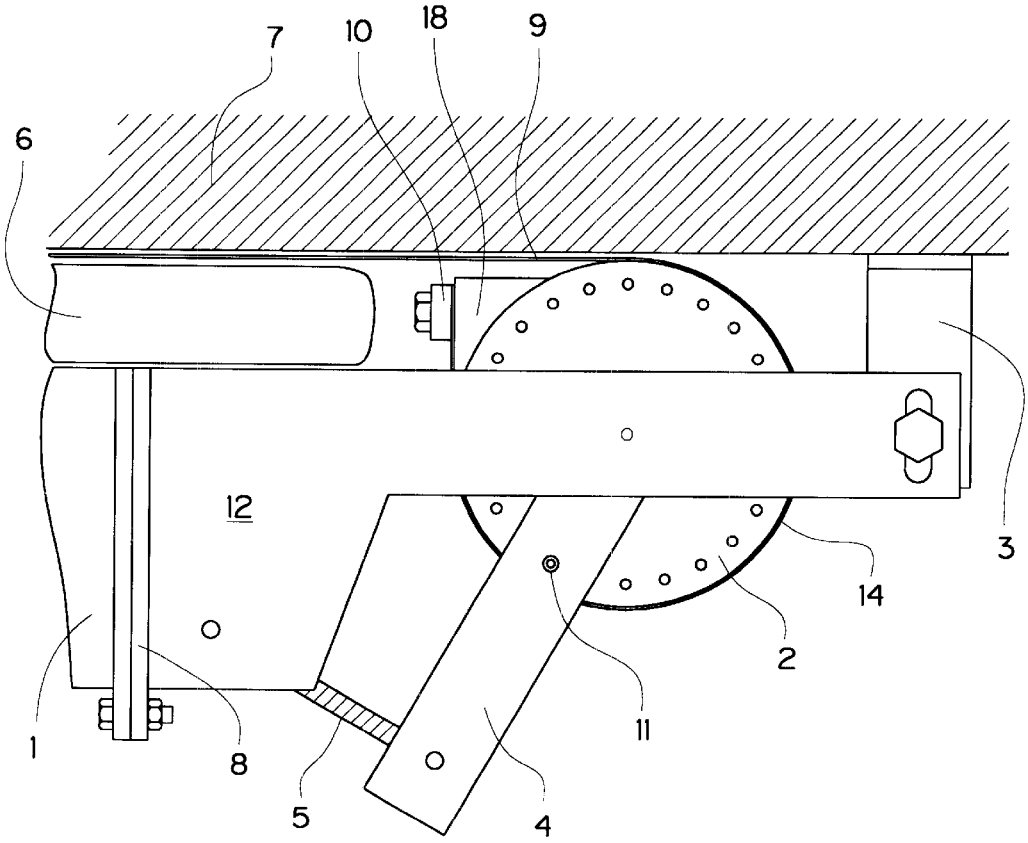
FIG. 2 is a side view of a stressing mechanism of the device, shown in detail.

FIG. 2 shows an enlarged view of the actual stressing unit. In this case, curved surface 14 is formed by wheel 2, which is rotatably mounted on a frame 12. An adjustable fixing device 3 is provided on frame 12, for the purpose of provisionally fixing the entire device to the construction 7 to be reinforced. Lamella 9, or strip 9, is introduced into the device and is wound around a contact angle of 270° by rotating curved surface 14. Bolt 11 locks lever 4 in discrete positions of wheel 2 on frame 12. The prestressing force can be maintained by means of a locking device 5. The elements required to apply the prestressing force, e.g. a hydraulic pistoncylinder unit or a screw link actuator, may be part of the stressing unit, or may alternatively be add-on modules, so that they only need to be mounted on the device as required and then removed again after the prestressing process. The frame 12 of the stressing unit and stressing mechanism is connected to a connection support 1 via mounting flange 8. The stressing device is attached to the construction 7 requiring reinforcement via two fixing devices 3, which are connected to the stressing device so that they are vertically displaceable and lockable. This vertical height is only set after the stressing device contacts construction 7, so that a perfect contact and positioning can be produced. On at least one side of the stressing device the means of attaching the device must be contrived as a longitudinally displaceable movable bearing in order to be able to accommodate any linear expansion of the stressing device.

Figure 3:
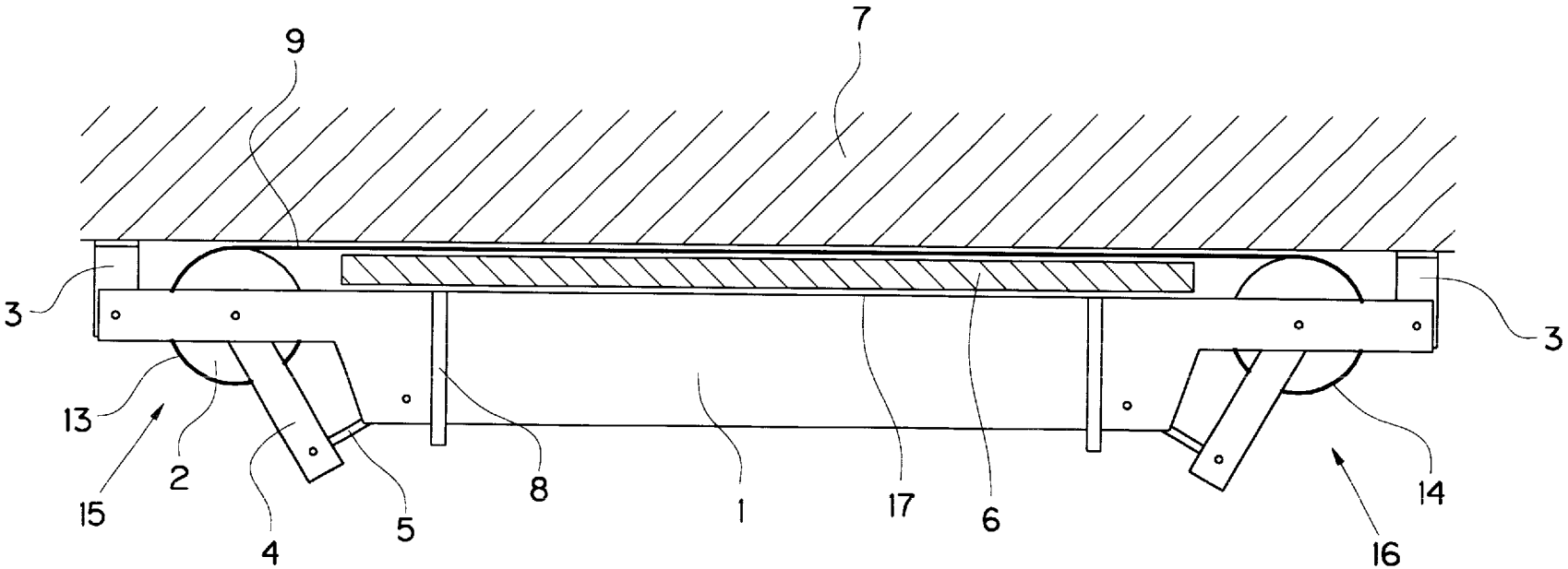
FIG. 3 is a schematic side view of an entire device, with a prestressed reinforcing strip, mounted on a construction just before the reinforcing strip is applied to the construction.

In addition to providing a means of prestressing strip 9, the device also enables the strip 9 to be attached to construction 7 and then held in the prestressed state until the adhesive hardens. The entire device required for this purpose is shown in FIG. 3, which is a side view. This device comprises a rigid steel or aluminum support 1, an extruded or welded box girder, a framework or a wound fibre reinforced plastic support which is fixed between two stressing units 15,16 as described above, and acts as a means of mounting the units opposite each other. The curved surface 13 at one end can be rotated, while the curved surface 14 at the opposite end can also be rotated, but does not have to be rotatable. In this drawing, the ends of the overall prestressing device have the adjustable fixing devices 3 used to attach it provisionally to construction 7. At least one fixing device 3 is contrived as a longitudinally displaceable movable bearing.

FIG. 3 shows the stressing device immediately before strip 9 is applied to construction 7. Placed between lamella or strip 9 and support 1 of the prestressing device there is an air bag 6 or extensible air hose, which, when air pressure is applied, exerts a uniform pressure across the entire surface of the lamella or strip 9 in contact with the construction.

To apply a lamella 9, the device is first loaded with a strip. The strip or lamella 9 is first tangentially contacted with the curved surface on the two wheels 2 of the device which is e.g. lying on the ground, and then fixed to both surfaces 13,14 by means of holding devices 18, as shown in FIG. 1, and the associated clamping screws. Curved surfaces 13,14 can be surface treated, or suitable films can be inserted between them to adjust the friction coefficient between curved surfaces 13,14 and lamella 9 over large areas and, with it, the residual prestressing force at the holding device 18, as shown in FIG. 1, of lamella 9 after stressing. The two curved surfaces 13,14 are rotated by hand or with a tool until lamella 9 is wound around a certain contact angle, thereby developing sufficient static friction on the two curved surfaces 13,14 so that by rotating one of surfaces 13 or 14 even further, lamella 9 can be prestressed. The lever is provisionally locked in an ideal position with a bolt 11, as shown in FIG. 2, and then the stressing device for applying the necessary prestressing force is installed. This force can be applied hydraulically or pneumatically by an appropriate piston-cylinder unit, or by means of a screw link actuator, or simply by means of a screw. After applying the prestressing force, the stressing device is removed from the device, unless the stressing device is designed as part of and rigidly connected to the overall device. Rotatable curved surfaces 13,14 are locked in place with locking device 5 so that the applied prestressing force is reliably maintained. Adhesive is then spread over the appropriate points of prestressed lamella 9 in the desired thickness. The device with the prestressed lamella 9 on it is then brought up to construction 7. For this purpose a lifting appliance, preferably a hydraulic excavator with a fully rotatable grabber, a crane or a hydraulic lifting platform is used to bring the device up to construction 7 and the pre-treated concrete surface to be reinforced, and positioned in such a way against the construction strip 9 is located in the desired position, where it runs in the right direction. The device is then provisionally fixed to construction 7 by means of the two vertically adjustable fixing devices 3. Fixing devices 3 are then adjusted so that lamella 9 lies flush against the construction. Finally, compressed air is applied to the air bag 6 or air hose associated with the device so that lamella 9 is pressed evenly against construction 7 over the whole of its area to be bonded to construction 7. Lamella 9 is therefore pressed against construction 7 in a prestressed state until the adhesive is completely dry. If required, the tension in lamella 9 can be measured with strain gauges applied to lamella 9. In the event of large fluctuations during the hardening period cause by the change in temperature between day and night, a heater disposed in the support of the prestressing device can be used to regulate its temperature with a view to compensating changes in temperature and thereby avoiding any dilatation. It is only when the adhesive is completely dry that the end anchorages of lamella 9 are moved into position and the prestressing force on at least one side of the device is slowly reduced and the device is relieved. Lamella 9 is now cut through at the ends of the bonded areas. As soon as this has been done, fixing devices 3 can be detached, and the device can be moved away again from construction 7 by means of the crane or excavator.

A slightly different form of the same device can also be used in a slightly different way for reinforcing with discontinuously prestressed lamella 9. In this case the lamella 9 applied to the construction is not evenly prestressed along its full length, but is less prestressed at its ends, or indeed not at all, while other zones, usually in the middle of the lamella 9, but in other areas as well, are prestressed to a maximum. This distribution of prestressing force is achieved by creating a local bond between construction and lamella 9 in small areas and then subsequently adjusting the prestressing of the lamella 9 areas yet to be bonded. In each already bonded area, the lamella 9 therefore stores the degree of prestress prevailing when the bond was initially produced.

Figure 4A:
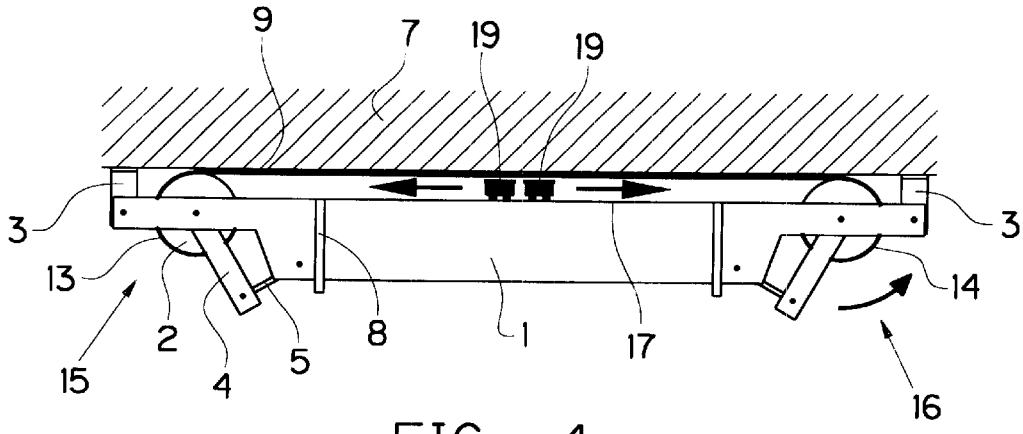
FIG. 4*a* is a schematic side view of an entire device, during the process of applying a discontinuously stressed strip, with the two heating/press-on elements moved from a center zone towards ends of the stressing device.

FIG. 4*a* shows the device for applying a discontinuously stressed lamella. There is no air bag 6. Disposed between support 1 and the stressed lamella 9 there is at least one heating/press-on element 19 which can be displaced in the longitudinal direction of the device. In the example shown there are two such heating/press-on elements 19. These heating/press-on elements 19 can be moved along the entire length of the support either by hand or preferably by some motorized means. They may be driven by an electric motor for example, and displaced along a rail and, for example, a toothed rack on the support. Heating/press-on elements 19 could also be pulled across support 1 along a slide rail by means of e.g. an electric rope haulage system. They are equipped with electric heaters and the heating and drive functions can preferably be remote controlled. Each element 19 heats up the section of lamella with which it is in contact, and presses it against construction 7. The heat produces or accelerates the bond between the section of lamella 9 and the construction. In the example illustrated, these heating/press-on elements 19 are moved outwards from the center of lamella 9. While these elements 19 are slowly moved outwards, the prestressing force of lamella 9 is reduced by the required amount, either continuously or in discrete steps. Lamella 9 therefore ends up securely bonded to construction 7 with varying prestressing forces over its entire length, so that the prestressing force is distributed exactly as required over the entire length of the lamella 9.

Figure 4B:
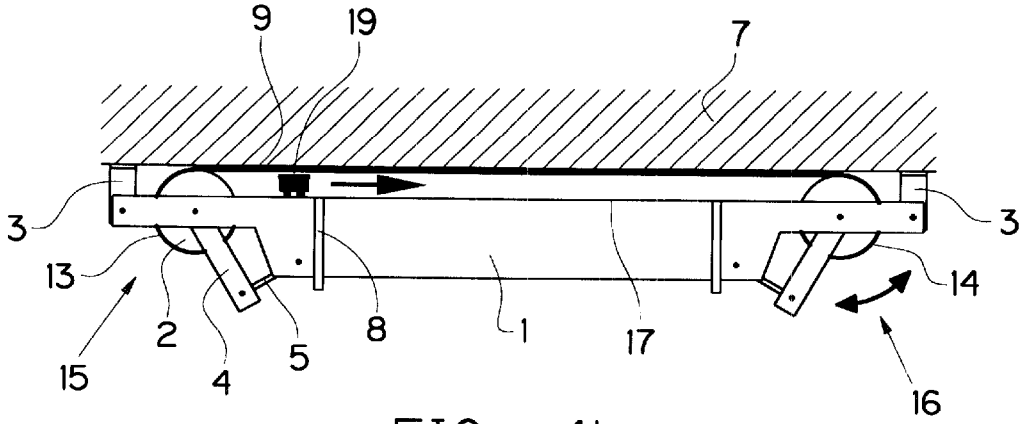
FIG. 4*b* is a schematic side view of an entire device, during the process of applying a discontinuously stressed strip, with one heating/pressure element moved from one end of the stressing device to the other end.

The same distribution of the prestressing force in the lamella 9 can also be achieved by using just one heating/press-on element 19, as shown in FIG. 4*b*. Here, this heating/press-on element 19 is moved from one end of the stressing device to the other. Starting from a minimum value, the prestressing force applied to lamella 9 is increased continuously or in steps up to the maximum value, while heating/press-on element 19 is simultaneously displaced, in this case from left to right, until heating/press-on element 19 reaches the middle of lamella 9, for example. The prestressing force is then reduced to the required minimum value, while heating/press-on element 19 is simultaneously displaced towards the right of the drawing to the other end of lamella 9.

The stressing force applied to lamella 9 is applied and altered with precisely positionable and controllable hydraulic piston-cylinder units or screw link actuators. The precise degree of prestressing is measured with strain gauges positioned on the lamella 9, or by means of an integral force measuring device in the prestressing device. Heating/press-on elements 19 can be displaced by hand, or preferably automatically along the entire length of the section being stressed. It is advantageous if the entire operation can be remote-controlled, especially when prestressed strips have to be attached to bridges at great heights using cranes or excavators, for example. The same applies when working with hollow structures, where the strip has to be contacted with the construction from the inside, with the result that access is restricted.

In those instances in which the prestressing force applied to the strip 9 has to be altered while the strip 9 is bonded, the two fixing devices 3 of the prestressing device both have to be contrived as longitudinally displaceable movable bearings so as to avoid a static indeterminacy of the attachment of the stressing device to the construction.

Figure 4C:
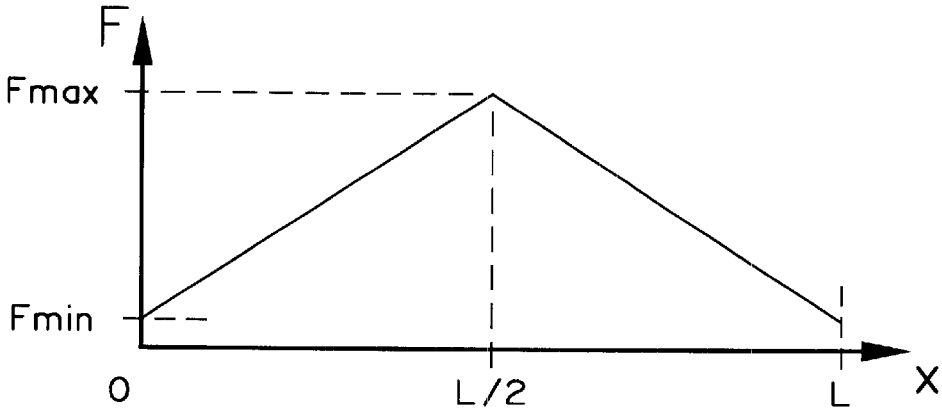
FIG. 4*c* is a graph showing the development of the degree of prestressing along the fully applied discontinuously stressed strip.

FIG. 4*c* shows an example of the possible development of the degree of prestressing in lamella 9. In this case, lamella 9 has an identical minimum prestressing force, Fmin, at its ends, which increases continuously towards the center of lamella 9 until it reaches a maximum prestressing force Fmax. The development of the prestressing force applied to lamella 9 over its entire length can, however, be adapted to suit each particular application.

What is claimed is:

1. In a method for applying a prestressed reinforcing strip (9) to a construction (7) in which the strip (9) is pre-treated with an adhesive and then brought up to a construction and bonded to the construction, the improvement comprising: stretching the strip (9) so that the strip (9) has a prestressing force, bringing the strip (9) up to the construction by a device on which the strip (9) can be stretched to the prestressing force, the device pressing the strip (9) gradually against a corresponding, pre-treated part of the construction (7), section by section with varying degrees of prestressing until an adhesive on each section hardens between the strip (9) and the construction (7).

2. In a method for applying a prestressed reinforcing strip (9) to a construction (7) in which the strip (9) is pre-treated with an adhesive and then brought up to a construction and bonded to the construction, the improvement comprising: stretching the strip (9) so that the strip (9) has a prestressing force, bringing the strip (9) up to the construction by a device on which the strip (9) can be stretched to the prestressing force, the device pressing the strip (9) against a corresponding, pre-treated part of the construction (7) with a continuously varying degree of prestressing and pressing locally until the adhesive hardens at a local point between the strip (9) and the construction (7).

3. In a method for applying a prestressed reinforcing strip (9) to a construction (7) in which the strip (9) is pre-treated with an adhesive and then brought up to a construction and bonded to the construction, the improvement comprising: stretching the strip (9) so that the strip (9) has a prestressing force, bringing the strip (9) up to the construction by a device on which the strip (9) can be stretched to the prestressing force, the device pressing the strip (9) against a corresponding, pre-treated part of the construction (7) until an adhesive hardens between the strip (9) and the construction (7), wherein:

the strip (9) is stretched and attached at both ends of the strip (9) and routed around two convexly curved surfaces of (13,14) a device;

the strip (9) is prestressed by rotating at least one of the convexly curved surfaces (13,14) in a circumferential direction;

a first section of the strip (9) to be applied is provided with the adhesive on a side of the strip (9) facing construction (7);

the first section of the strip (9) is prestressed and is brought up together with the device to the pre-treated area for reinforcement on the construction (7), and the device is detachably fixed in place at the pre-treated area by adjustable fixing devices (3);

the device is pressed against the construction (7) by the adjustable fixing devices (3) until the curved surfaces (13,14) are pressed against the construction (7) where the strip (9) tangentially exits the curved surfaces (13,14);

the first section of the strip (9) between the curved surfaces (13,14) is pressed against the construction (7) one of locally and along an entire length until the adhesive hardens with a degree of prestressing altered for the different sections;

the prestressing force applied to the strip (9) released by rotating at least one of curved surfaces (13, 14) backwards, and a bonded section of strip (9) detached from the device; and the device moved away from the construction (7).

4. In the method of claim 3, wherein the strip (9) is stretched and attached at both ends of the strip (9) and routed around two convexly curved surfaces of (13,14) a device:

the strip (9) is prestressed by rotating at least one of the convexly curved surfaces (13,14) in a circumferential direction;

a first section of the strip (9) to be applied is provided with the adhesive on a side of the strip (9) facing construction (7);

the first section of the strip (9) is prestressed and is brought up together with the device to the pre-treated area for reinforcement on the construction (7), and the device is detachably fixed in place at the pre-treated area by adjustable fixing devices (3);

the device is pressed against the construction (7) by the adjustable fixing devices (3) until the curved surfaces (13,14) are pressed against the construction (7) where the strip (9) tangentially exits the curved surfaces (13,14);

the strip (9) between the two curved surfaces (13,14) is pressed against the construction (7) by an inflatable air bag (6) between the device and the strip (9) until the adhesive hardens, and then releasing the air bag (6) by evacuating compressed air in the air bag (6);

the prestressing force applied to the strip (9) released by rotating at least one of curved surfaces (13, 14) backwards, and a bonded section of strip (9) detached from the device; and the device moved away from the construction (7).

5. In the method of claim 3, wherein the strip (9) is stretched and attached at both ends of the strip (9) and routed around two convexly curved surfaces of (13,14) a device;

the strip (9) is prestressed by rotating at least one of the convexly curved surfaces (13,14) in a circumferential direction;

a first section of the strip (9) to be applied is provided with the adhesive on a side of the strip (9) facing construction (7);

the first section of the strip (9) is prestressed and is brought up together with the device to the pre-treated area for reinforcement on the construction (7), and the device is detachably fixed in place at the pre-treated area by adjustable fixing devices (3);

the device is pressed against the construction (7) by the adjustable fixing devices (3) until the curved surfaces (13,14) are pressed against the construction (7) where the strip (9) tangentially exits the curved surfaces (13,14);

the strip (9) between the two curved surfaces (13,14) is heated by at least one heating/press-on element (19) over an entire length of the strip (9) and the strip (9) pressed against the construction (7) until the adhesive hardens;

the prestressing force applied to the strip (9) released by rotating at least one of curved surfaces (13,14) backwards. and a bonded section of strip (9) detached from the device; and the device moved away from the construction (7).

6. A device for for applying a tension-proof reinforcing strip (9) to a construction (7) comprising; a support (1), on ends of which are mounted a plurality of convexly curved surfaces (13,14) disposed pressure-resistantly and rigidly at a distance from each other and facing outwards in relation to the support (1), holding devices (18) for attaching the strip (9) resting on the curved surfaces (13,14) in a circumferential direction, the support (1) designed so that the two curved surfaces (13,14) are connectable along a tangent from one section of the strip (9), at least one of the curved surfaces (13,14) rotatable in the circumferential direction and lockable in a rotated position, and means for detachably fixing the device to the construction (7).

7. The device of claim 6, wherein the curved surfaces (13,14) are formed by two wheels (2) mounted on an intermediate support (1), with one of mechanical, hydraulic and pneumatic drive means for rotating at least one of the wheels (2), which can be locked in the rotated position by a locking device (5).

8. The device of claim 7, wherein the support (1) occupies a space between the two curved surfaces (13,14), and on a side on which the strip (9) is stretched forms a flat surface (17) oriented towards the strip (9), and on the flat surface (17) an inflatable air bag (6) is disposed for pressing outward the strip (9) stretched between the curved surfaces (13,14).

9. The device of claim 7, wherein the support (1) occupies a space between the two curved surfaces (13,14), and on a side on which the strip (9) is stretched is at least one heating/press-on element (19) which can be displaced along a length of the strip (9) stretched between the curved surfaces (13,14) for heating and pressing the strip (9) against the construction (7).

10. The device of claim 6, wherein the support (1) occupies a space between the two curved surfaces (13,14), and on a side on which the strip (9) is stretched forms a flat surface (17) oriented towards the strip (9), and on the flat surface (17) an inflatable air bag (6) is disposed for pressing outward the strip (9) stretched between the curved surfaces (13,14).

11. The device of claim 6, wherein the support (1) occupies a space between the two curved surfaces (13,14), and on a side on which the strip (9) is stretched is at least one heating/press-on element (19) which can be displaced along a length of the strip (9) stretched between the curved surfaces (13,14) for heating and pressing the strip (9) against the construction (7).

* * * * *